United States Patent [19]

Ashworth, Jr.

[11] 4,060,803

[45] Nov. 29, 1977

[54] SECURITY ALARM SYSTEM WITH AUDIO MONITORING CAPABILITY

[75] Inventor: Charles S. Ashworth, Jr., Warren, Mich.

[73] Assignee: Audio Alert, Inc., Farmington Hills, Mich.

[21] Appl. No.: 656,244

[22] Filed: Feb. 9, 1976

[51] Int. Cl.[2] ..... G08B 29/00

[52] U.S. Cl. ..... 340/409; 340/412; 340/420

[58] Field of Search ..... 340/409, 412, 276, 285, 340/420

[56] References Cited

U.S. PATENT DOCUMENTS

| | | | |
|---|---|---|---|
| 3,404,393 | 10/1968 | Blivice et al. | 340/409 |
| 3,678,509 | 7/1972 | Carlo et al. | 340/409 |
| 3,697,984 | 10/1972 | Atkinson et al. | 340/409 |
| 3,706,987 | 12/1972 | Westphal | 340/409 |
| 3,707,708 | 12/1972 | Dan | 340/409 |
| 3,820,102 | 6/1974 | Schubert | 340/409 |

*Primary Examiner*—John W. Caldwell, Sr.
*Assistant Examiner*—Donnie L. Crosland
*Attorney, Agent, or Firm*—Cullen, Settle, Sloman & Cantor

[57] ABSTRACT

A security alarm with audio monitoring capability including a remote location to be protected, a central monitoring station and transmission lines coupled therebetween. The remote location includes a circuit for generating a DC transmission signal of a first normal polarity. Sensors are provided for detecting various alarm conditions and a switching apparatus responsive to the detection of an alarm condition by the sensors reverses the polarity of the DC signal to indicate the existence of an alarm condition. A plurality of microphones each having its own amplifier and sensitivity control are strategicaly placed about the remote location to pick up audio sounds originating therein. The AC audio signals from the microphones are superimposed onto the DC transmission signal and transmitted to the central monitoring station. The central monitoring station includes a first circuit isolated from the transmission lines by a first photo-optical coupler which monitors for open circuit or short circuit line faults; a second circuit isolated from the transmission lines by a second photo-optical coupler which monitors for a polarity reversal and generates an alarm signal indicative thereof; and a third circuit is isolated from the transmission lines by a transformer and which receives the superimposed AC audio signals. The third circuit renders all signals above a predetermined level audible to the operator at the central station.

Additionally, the remote location may include a closed security loop having a plurality of serially connected normally-closed switches through the doors and windows which trigger a polarity reversal if the integrity of the loop is broken; a circuit for testing loop integrity; a signal injector for generating different and distinct audio tones for each different type of alarm condition possible and for superimposing the generated audio tones onto the DC transmission signal; and photo-optical line supervision circuitry. Furthermore, either or both of the remote location and the central station may be provided with manually operable coding keys for sending coded signals over the transmission lines.

12 Claims, 8 Drawing Figures

SECURITY ALARM SYSTEM WITH AUDIO MONITORING CAPABILITY

BACKGROUND OF THE INVENTION

1. Field of the Invention

This invention relates to a supervised security alarm system having audio monitoring capabilities, and more particularly to an alarm system wherein one or more remote stations to be protected can communicate with a central monitoring station via a two-wire telephone line to provide line supervision, alarm condition recognition and indication, and audio monitoring capabilities.

2. Description of the Prior Art

There are many types of security alarm systems wherein a remote station under surveillance is interconnected via transmission lines to a central monitoring station to allow an operator at the central station to monitor for various alarm conditions. Most of these systems simply trigger an audible or visual alarm when a particular alarm condition, such as the breaking of a perimeter protection loop at the remote location has occured. Very few of the systems of the prior art provide audio monitoring capabilities at the remote location and most of those that do, utilize sounds or sonic vibrations at the remote location to trigger an alarm indication at the central station rather than monitoring the actual sounds generated at the remote location itself.

Most of the central stations of the prior art utilize a plurality of relay means to detect changes in conditions at the remote station and to generate the alarm indication. Many of these relays are relatively slow-acting, involve moving parts which are mechanically unreliable, and require relatively large power supplies for operation.

The few sound monitoring systems which do exist, generally rely on sound monitoring alone and are not generally used in combination with other security alarm systems. Furthermore, they are usually continuously powered resulting in an unnecessary invasion of the privacy of the person whose remote station is being protected. If privacy is desired and the power is turned off, the sound monitoring capability, and generally the entire alarm detection capability of the system is lost.

The few sound monitoring systems of the prior art are further plagued with the problems that they are easily triggered by normal environmental noise or random noise generated in the vicinity of the remote location. Tolerance settings and threshold levels become critical, effect the operation of the system and often lead to all-too-numerous false alarms and an eventual failure of confidence in the system.

In general, the systems of the prior art are relatively simple and can be defeated by a relatively unsophisticated burglar or intruder. Furthermore, the systems are prone to false alarms and to mechanical failures. Additionally, the systems are relatively expensive and difficult to maintain and have a relatively slow response time while consuming considerable quantities of power. The central monitoring stations are especialy susceptible to damage from surge currents and voltage spikes such as may be generated by system irregularities, lightening, and the like which can render the central monitoring station inoperative and cause damage to the expensive monitoring equipment.

The present invention overcomes these disadvantages of the prior art by providing a low-cost, easy-tooperate maintenance-free, highly reliable central monitoring station which is virtually isolated from transmission line irregularities and which provides (1) line supervision capability, (2) alarm condition detection and indication capability, and (3) sound monitoring capabilities which allows the operator at the central station to monitor the actual sounds originating from he remote location. The present invention also provides a relatively sophisticated security alarm system at the remote location which incorporates (1) a sound monitoring system, (2) normal closed loop perimeter protection capability, (3) the monitoring of any number of distinct and different types of alarm conditions such as hold-up, fire, and the like, (4) signal injection capability for superimposing different and distinct audio tones onto the DC transmission signal to allow the operator at the central station to differentiate between various types of emergency conditions, and (5) one or two way coding key capability to allow either the operator at the central station, a person at the remote location, or both, to send coded signals to one another.

SUMMARY OF THE INVENTION

The present invention provides a security alarm system with audio monitoring capability which includes a remote location to be protected, a central monitoring station, and transmission lines such as a typical two-wire telephone line coupled between the remote location to be protected and the central monitoring station. The remote location includes a circuit for generating a DC transmission signal of a first normal polarity and means for coupling this DC signal onto the transmission lines. Sensors are provided for detecting various alarm conditions such as hold-up, fire, and the like. A switching apparatus responsive to the detection of one of these alarm conditions by the sensors is able to reverse the polarity of the DC transmission signal to indicate the existence of an alarm condition. A plurality of individual microphones, each having its own amplifier and sensitivity control, are strategically placed about the remote location to pick up audio sounds originating therein. The AC audio signals from the microphones are superimposed onto the DC transmission signal for transmission over the transmission lines to the central monitoring station. The central monitoring station includes a first circuit isolated from the transmission lines by a first photo-optical coupler which provides line supervision capabilities and monitors for open circuit or short circuit line fault conditions. A second circuit isolated from the transmission lines by a second photo-optical coupler monitors for a polarity reversal and generates an alarm condition indicative thereof. A third circuit is isolated from the transmission lines by a transformer and receives the superimposed AC audio signals. The third circuit renders all audio signals above a predetermined threshold level audible to the operator at the central station.

Additionally, the remote location may include a closed security loop having a plurality of serially connected, normally-closed switches about the perimeter of the premises to be protected, for example, through the doors and windows thereof, which will trigger a polarity reversal when the integrity of the closed loop is broken. Additionally, a line supervision circuit may be provided at the remote location and a circuit for testing the closed loop integrity may also be provided. The remote location may be provided with a signal injector for generating different and distinct audio tones for each different and distinct type of alarm condition which may be detected at the remote location and for superimposing the generated audio tones onto the DC signal for transmission to the central monitoring station. Either the remote location or the central monitoring station, or both, may be provided with manually operable coding keys for sending coded signals over the transmission lines.

The security alarm system of the present invention provides total solid state reliability at the central monitoring station. No relays or other moving parts are used at the central monitoring station resulting in higher reliability, lower cost, and less maintenance. Photo-optical couplers are used to interface with the transmission lines to isolate the line supervision circuits and alarm detection circuits from current surges and voltage spikes often experienced on the transmission lines thereby preventing damage to the circuits at the central station which could result in monetary loss and in temporarily rendering the monitoring station inoperative.

The present security alarm system provides sound monitoring capabilities wherein the actual sound generated at the remote location not only serve as one means for triggering an alarm condition, but may also be directly monitored at the station to allow the operator to listen to the actual sounds eminating from the protected area. If there is an emergency, the appropriate authorities may be notified and this capability greatly reduces the incidence of false alarms. The audio monitoring system at the remote location includes a plurality of microphones each of which includes its own amplifier and sensitivity adjustment means. This allows the microphones to be individually adjusted depending on the area in which they are placed to balance out normal background noise. The audio monitoring system does not require a constant supply of power to the microphones since a four-position manually operable switch is provided so that the microphones are normally powered only when the switch is in the "on" position thereby preserving the privacy of the persons located at the remote station. The audio system, however, will be immediately energized even if the manually positionable switch is in the "off" position should any other type of alarm condition be detected, thereby overriding the "off" position of the switch and allowing the operator at the central station to monitor the actual sounds at the remote location once an alarm condition has been triggered.

The security alarm system of the present invention provides multiple forms of alarm indication. In addition to the audio monitoring system, a closed loop perimeter protection system is used to detect an intruder or the like and various special types of sensors are provided to detect different and distinct types of alarm conditions such as hold-up, fire and any other type of special condition to be monitored, whether it be an alarm condition, the temperature of a boiler, or some similar warning signal. All of these systems are interrelated and the detection of any type of alarm condition reverses the polarity of the DC signal transmitted over the transmission lines to indicate the existence of an alarm condition to the central station.

The line supervision circuitry at the central station insures that an open circuit or short circuit line fault will not be interpreted as an alarm condition and that a polarity reversal will always be recognized as an alarm condition. A photo-optical line supervision circuit at the remote location allows the generation of the DC transmission signal to be monitored and can be used for testing the integrity of the closed loop and in the ring-back capabilities to be discussed hereinafter.

The audio monitoring circuit at the central location includes a threshold amplifier which permits only those audio signals above a predetermined level to be gated to the speaker so that the operator at the central station is not forced to listen to constant background noise and the like but only to sounds above a predetermined level, generally indicating an alarm condition, and the sounds eminating from the protected location once an alarm condition has been generated. The threshold level can be selectively determined and controlled at the central station to suit the needs of the situation and the particular audio monitoring circuit which has been gate-triggered may have a visual latch for identification purposes.

The remote location of the present invention is provided with a manually operable four-position key-controlled switch having an "on", and "off", a "test", and a "signal" position. When the switch is in the "test" position, the closed loop perimeter security circuit may be connected to the indicator means of the line supervision circuit to test the integrity of the closed loop. As indicated previously, even when the switch is in the "off" position, certain of the alarm sensors remain operative and the detection of an alarm condition will activate the audio monitoring system even though the switch remains in the "off" position. Normally, the person at the remote location will turn the key switch to the "on" position when protection is desired and this activates all of the protection circuits at the remote location. In the signal position, a manually operable coding key is switched into the circuit for transmitting the DC signal and a person at the remote location can operate the key to send coded messages to the central station.

Additionally, a similar manually operable coding key is provided in series with the transmission line at the input to the central station and may be manually operated to intermittently open and break the circuit to transmit a coded signal and allow a person at the remote location to read the coded message by observing the indicator circuit associated with the line supervision circuitry at the remote location.

In addition to all of these combined capabilities, the system of the present invention includes a signal injection circuit which responds to the various different and distinct types of alarm conditions to generate corresponding different and distinct types of audio tones and to superimpose the resulting AC audio signals onto the DC signal to be transmitted to the central location for providing various audible tones at the remote location for enabling the operator to differentiate between the various types of alarm conditions and determine which type triggered the present alarm status.

Additionally, the signal injection circuit of the present invention provides a means whereby, at least for certain of the alarm conditions, the audio tones are generated for a predetermined period of time and then automatically silenced for a predetermined period of time and so on to enable the operator at the central location to monitor for the actual sounds originating at the remote location during the periods in which the audio tones indicative of the various alarm conditions are not being generated. In summary, the security alarm system with audio monitoring capability of the present invention provides a highly reliable, low-cost, easy-tomaintain, fast-reacting alarm system which has received immediate commercial acceptance in the field.

Other objects, features and advantages of the present invention will be readily apparent and better understood by reference to the following detailed description when considered in conjunction with the appended claims and the accompanying drawings, a description of which follows:

DETAILED DESCRIPTION OF THE PREFERRED EMBODIMENTS

Figure 1:
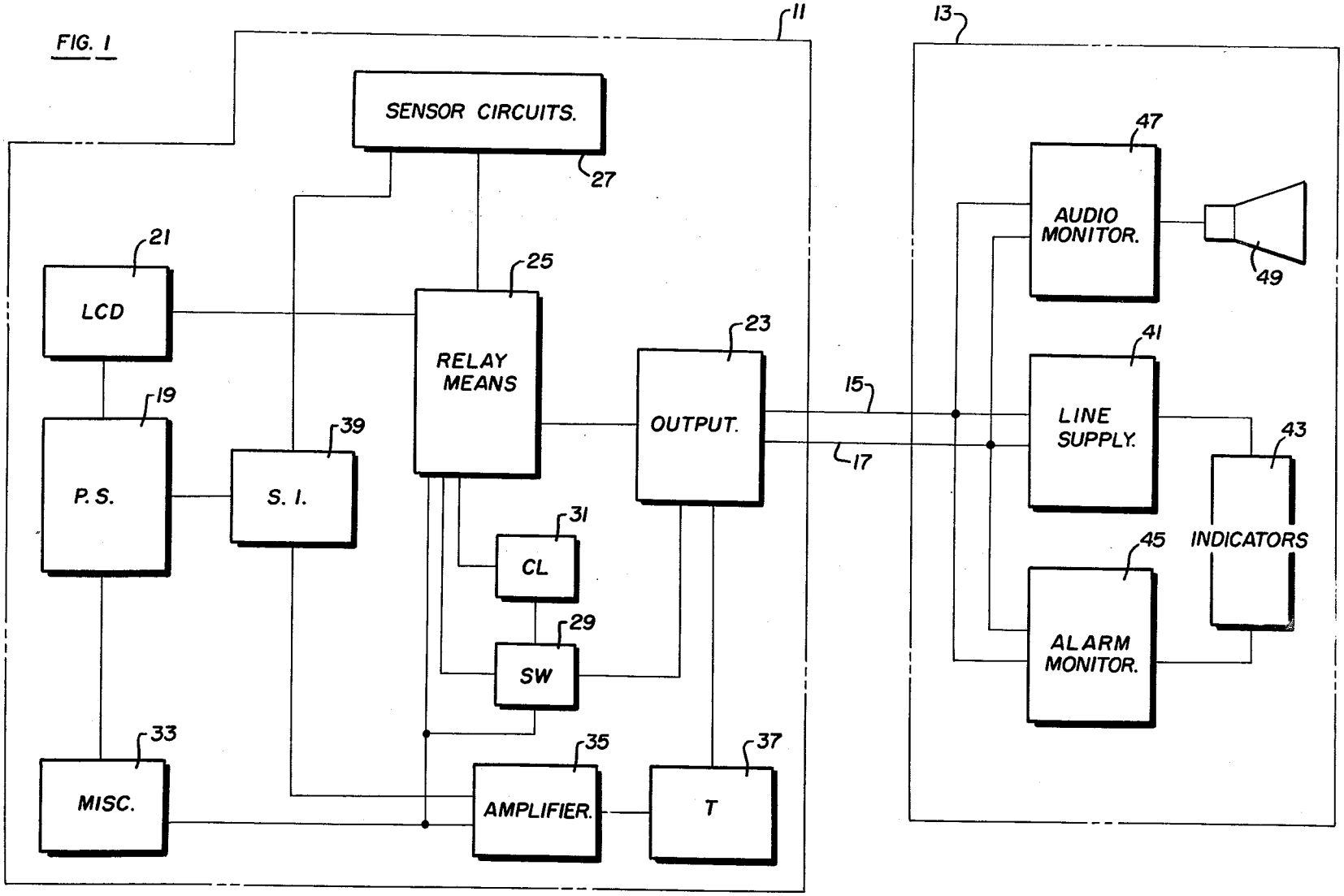
FIG. 1 is a block diagram of the security alarm system of the present invention.

FIG. 1 shows, in block diagram form, the security alarm system of the present invention. The remotely located premises to be protected or remote station 11 communicates with a central monitoring station 13 by means of a pair of transmission lines 15, 17. The remote station 11 includes a power supply 19 which generates a DC transmission signal which is transmitted to the central station 13 via transmission lines 15, 17. A supervisory circuit or line current detector 21 monitors the presence or absence of the DC signal so as to sense an open circuit anywhere along the transmission path. The generated DC transmission signal is supplied to the transmission lines 15, 17 through the output means of block 23. The generated DC signal is normally supplied to the output means of block 23 at a first normal polarity by the relay means of block 25. A plurality of sensor circuits 27 may sense one or more different and distinct types of alarm conditions and the relay means of block 25 respond to the detection or sensing of an alarm condition for reversing the polarity of the DC signal supplied to the output means 23 and transmitted over the lines 15, 17 to the central monitoring station 13. The reversal of the polarity of the DC signal indicates that an alarm condition exists at the remote station 11, as will hereinafter be explained. A manually operable four-position key-operated switching means 29 is provided at the remote location for controlling the status of the various circuits thereof and a closed loop perimeter security circuit 31 is provided which includes a series of normally closed switches through the doors and windows of the protected premises which respond to a break in the closed loop to cause the relay means 25 to reverse the polarity of the DC signal supplied to the output means 23.

The remote station 11 also includes a plurality of microphones 33 located at strategic positions about the premises to detect audio sounds originating in the protected area. The output of the microphones is supplied to a high gain audio amplifier 35 whose output is coupled to an audio transformer 37 which superimposes the AC audio signals onto the DC transmission signal at the output means 23 for transmission over the line 15, 17 to the central monitoring station 13.

The remote station 11 may also include a signal injector circuit 39 which responds to the detection of the different and distinct types of alarm conditions capable of being sensed by the circuit 27 and generates a different and distinct audio tone characteristic of the particular alarm condition which was sensed. The signal injector feeds this distinctive audio tone into the amplifier 35 and it is superimposed via the transformer 37 and the output circuit 23 onto the DC signal for transmission to the central monitoring station 13.

The central monitoring station 13 includes a first line supervision circuit 41 which monitors the incoming DC transmission signal continuously for an open circuit or short circuit condition. The line supervision circuit 41 responds to the detection of an open circuit or short circuit condition to trigger a fault indicator located in the indicator circuitry block 43. A second alarm monitoring circuit 45 monitors the polarity of the incoming DC transmission signal and senses a reversal from the normal polarity condition to trigger an alarm indication circuitry 43. The superimposed AC audio signals are received by the audio monitoring circuit of block 47 which contains circuitry adapted to pass only those signals above a predetermined level to the speaker 49. The speaker 49 renders audible the passed audio signals so that the operator at the central monitoring station 13 is able to listen to the actual sounds being made in the protected area 11 and detected by the microphones 33. Additionally, the audio monitoring circuitry 47 receives the audio tones generated by the signal injector 39 and renders them audible at the speaker 49 so that the operator can hear the distinct audio tone and differentiate between the various tones to determine the exact nature of the emergency condition sensed at the remote location.

Figure 2:
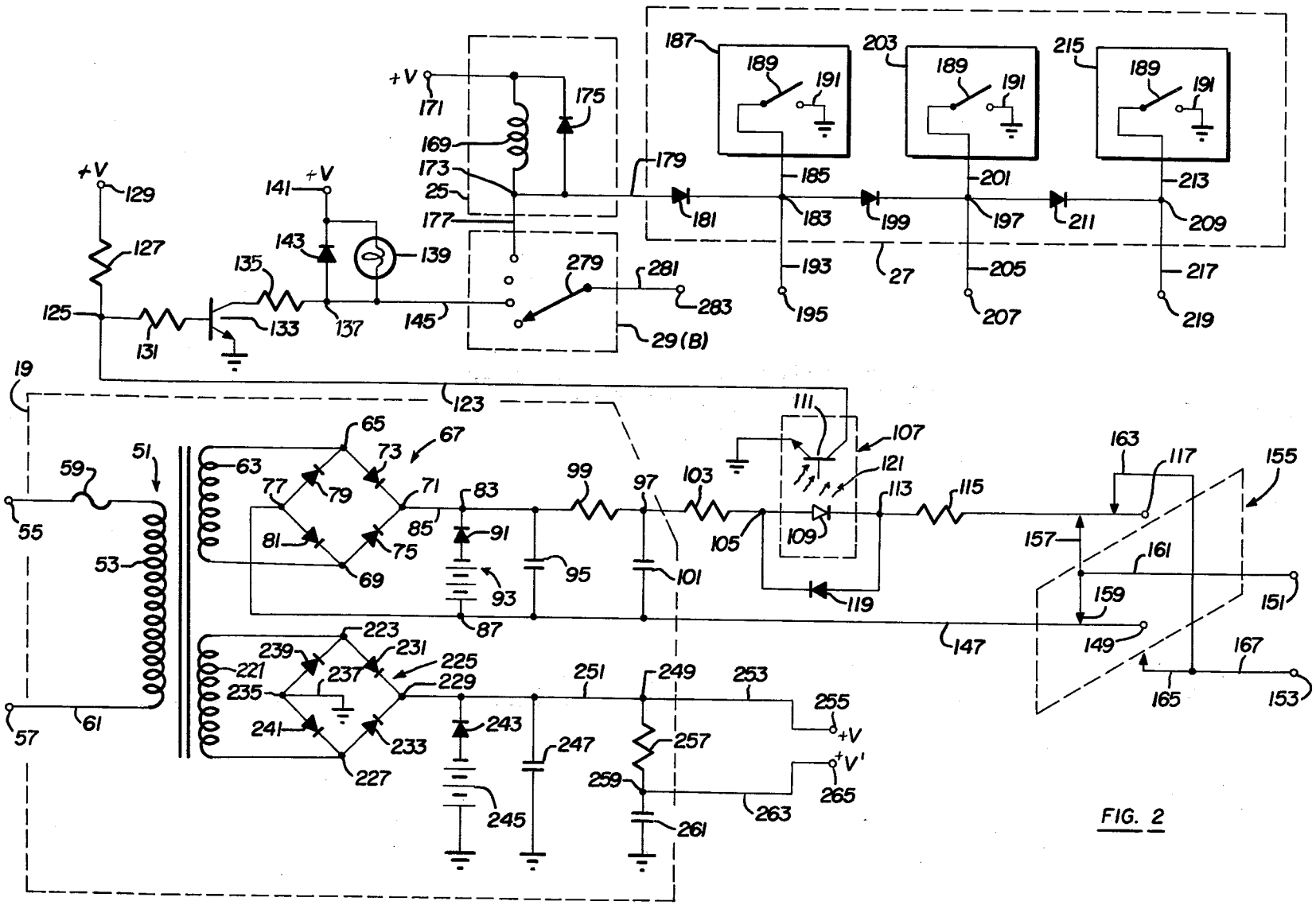
FIG. 2 is an electrical schematic of the power supply, line current detector circuit, sensor circuits, and a portion of the relay operated switching means of the system of the present invention.

More specifically, the system of FIG. 1 will be explained in detail with reference to the schematic diagrams of FIGS. 2 through 8. FIG. 2 illustrates, in schematic form, the circuitry of the power supply of block 19, the line current detector of block 21, the sensor circuits of block 27, a portion of the four-position switch of block 29, and a portion of the relay means of block 25. The basic component of the power supply of block 19 is a power transformer 51 having a primary winding 53. Normal AC voltage is supplied to the input terminals 55, 57. Input 55 is connected through a one amp fuse 59 to one end of the primary winding 53 and the opposite AC input terminal 57 is connected to the opposite end of the primary winding 53 via lead 61. A high voltage secondary winding 63 of the power transformer 51 has one end connected to a first input node 65 of a full wave rectifier 67 whose second input node 69 is connected to the opposite end of the high voltage winding 63. A first output node 71 is connected to the cathode of a diode 73 whose anode is connected to the first input node 65 and to the cathode of a second diode 75 whose anode is connected to the second input node 69.

A second output node 77 is connected to the anode of a third diode 79 whose cathode is connected to the first input node 65 and to the anode of a fourth diode 81 whose cathode is connected to the second input node 69. As known in the art, the four diodes 73, 75, 79 and 81 are configured to form the full wave rectifier 67 so as to provide a full wave rectified output signal between the nodes 71 and 77. The first output node 71 is connected to a node 83 via lead 85 and the second output node 77 is connected to a node 87 via lead 89. Node 83 is connected to the cathode of a fifth diode 91 whose anode is connected to the positive terminal of an emergency standby 67.5 volt battery 93 whose negative terminal is connected directly to the node 87. A capacitor 95 is also connected across the diode 91 and battery 93 combination between the nodes 83, 87 and the node 83 is connected to a node 97 through a resistor 99. The node 97 is connected to the node 87 through a capacitor 101 and through a resistor 103 to a node 105. Node 105 serves as the input to a photo-optical coupler 107 which is part of the line current detector circuit block 21 of FIG. 1. The photo-optical coupler 107 includes a photo or light-emitting diode 109 and a photo detector or photo transistor 111. The anode of the photo diode 109 is connected to input node 105 and its cathode is connected to an output node 113 which is connected through an output resistor 115 to positive output terminal 117. A protective diode 119 is coupled across the photo-optical coupler 107 with its anode connected to the output node 113 and its cathode connected to the input node 105, as known in the art.

Since the full wave rectifier 67 outputs a full wave rectified signal between the terminals 71, 77, current will continue to flow through the photo diode 109 so long as there is no open circuit or short circuit in the transmission lines 15, 17. The flow of current through the diode 109, which indicates that the circuit is working properly, causes the diode 109 to emit light or some form of radiation 121 during normal operation. The photo transistor 111 responds to the emitted radiation 121 impinging on its base to remain in a conductive state. The emitter of the photo transistor 111 is coupled directly to ground and its collector is connected via lead 123 to a node 125. Since node 125 is connected through a resistor 127 to a source of positive potential +V at terminal 129, the conduction of the photo transistor 111 establishes a current flow from the voltage input terminal 129 through the resistor 127, lead 123, and the conducting transistor 111 to ground during normal circuit operation. So long as this normal condition exists, the node 125 is approximately at ground and since it is connected through a resistor 131 to the base of a transistor 133 whose emitter is coupled to ground, the transistor 133 will remain in the nonconductive or "off" state.

The collector of the transistor 133 is connected through a resistor 135 to an indicator node 137. The indicator node 137 is connected to a warning light or indicator light 139 whose opposite end is connected to the source of positive potential +V at input terminal 141. A diode 143 is connected across the warning light 139 with its cathode connected to the voltage terminal 131 and its anode connected to the input node 137. The input node 137 is also connected via lead 145 to the second or "TEST" terminal of the "B" stage of the switch of block 29 which will be described in greater detail with respect to FIG. 3.

As previously indicated, so long as the photo transistor 111 remains in the normally conductive state in response to the continued transmission of the DC signal, transistor 133 is biased off. If, however, an open circuit or short circuit condition exists anywhere along the transmission path, current will cease to flow through the photo diode 109 and the radiation 121 will no longer be emitted. This will turn the photo transistor 111 off and allow the voltage at the base of transistor 133 to rise since it is connected to the +V input terminal 129 through resistors 127 and 131. The transistor 133 will then switch to a conductive state and a current path will be established between the +V power supply ofinput terminal 141, the warning light 139, the resistor 137 and the conducting transistor 133 to ground causing the warning light 139 to light. When the warning light 139 is on, therefore, it is an indication that a line fault has occurred and that the remote terminal 11 is not transmitting the DC signal to the central station 13.

The node 87 or negative node of the high voltage portion of the power supply of block 19 is connected via lead 147 to the second switching terminal 149. The pair of output terminals 117 and 149 are normally coupled to provide the DC transmission signal at a first or normal polarity between switching terminals 151, 153. The interconnection is made via a first relay-operated switch indicated generally by the reference numeral 155 and the dashed lines through the switches indicate that their operation is controlled by the energization of a relay coil to be hereinafter described. A first pair of relay-operated contacts 157, 159 are connected to the first switching output terminal 151 via electrical connection 161 and a second pair of contacts 163, 165 are connected to the second switching output terminal 153 via electrical connection 167. During normal operation, when the relay coil to be discussed hereinafter is not energized, the switch 155 is in the position shown with the positive output terminal 117 being connected to the second switching terminal 153 via contact 163 and connection 167. The second output 149 is connected to the first switching output terminal 151 via contact 159 and connection 161. This connection will supply the DC transmission signal generated by the power supply of block 19 to the output means of block 23 at a first or normal polarity. If the relay coil 169 is energized in response to the detection of an alarm condition, the contacts will change positions as indicated by the dashed lines so that the first output terminal 117 will be connected to the first switching output terminal 151 via contact 157 and connection 161 while the second output 149 will be connected to the second switching output 153 via contact 165 and connection 167 causing the DC signal supplied to the output means of block 23 to have its polarity reversed indicating that an emergency or alarm condition has been detected.

The relay means of block 25 is indicated as the dotted block 25 of FIG. 2 but in addition to that portion indicated in FIG. 2, it will be understood that the relay operated switching means 155 and the other relay operated switches to be discussed hereinafter are generally considered as a part of the block 25. The relay circuitry of block 25 includes a relay coil 169 which is normally de-energized during normal operation but which can be energized when an alarm condition has been detected to operate the various relay-operated switching means of the remote station 11. The relay coil 169, as shown in FIG. 2, has one end connected to the +V power supply via terminal 171 and its opposite end connected to a node 173. A protective diode 175 is connected across the relay coil 169 with its anode coupled to the node 173 and its cathode connected to the +V input terminal 171, as known in the art. The node 173 is connected via a lead 177 to the fourth position of the "B" stage of the four-position switch of block 29 which will be hereinafter described with reference to FIG. 3 and is connected through lead 179 to the sensor circuits of block 27. Lead 179 is connected to the anode of the diode 181 whose cathode is connected to a node 183. Node 183 is connected via lead 185 to a first sensor circuit or alarm condition detector 187. The nature of these circuits are well-known in the art and any type of alarm condition detector may be used. The contents of block 187 would normally include a normally opened switch 189 connected to the lead 187 and a grounded contact 191. The switch would remain open so long as there was no emergency condition, but once an emergency condition is detected, the switch 189 closes on the grounded contact 191 and establishes a current path between the +V input 171 and ground through the relay coil 169, lead 179, diode 181, lead 185, and switch 189 such that the relay coil 169 is energized to indicate the existence of an alarm condition and control the operation of the relay-operated switches of block 25 of the remote station 11.

The detector of block 187 could be any of a number of different types of alarm sensing circuits, for example, block 187 could correspond to a fire or smoke detection circuit which would close switch 189 in response to the detection of excess heat or smoke. This would represent one different and distinct type of alarm condition being monitored by the sensor circuits of block 27 of FIG. 1. Node 183 is also connected via lead 193 to the fire detector output terminal 195 for use with the signal injector circuitry of FIG. 7 to be hereinafter described. Node 183 is connected to another detector node 197 through a diode 199 whose anode is connected to the node 183 and whose cathode is connected to the node 197. Node 197 is connected through a lead 201 to a second different and distinct type of alarm detector 203 which includes a similar normally opened switch 189 and corresponding grounded contact 191 as discussed with respect to the detector 187. Detector 203 could, for example, be a hold-up detector switch or the like whose closure in response to the detection of a hold-up would establish a circuit path to energize the relay coil 169 to indicate an alarm condition as previously described. Node 197 is also connected through a lead 205 to a hold-up detector output 207. Node 197 is connected to a node 209 through a diode 211 whose anode is connected to the node 201 and whose cathode is connected to the node 209. Detector node 209 is connected through a lead 213 to a third different and distinct type of detector circuit 215 having a similar normally opened switch 189 and normally grounded contact 191 as previously described. This detector circuit could, for example, monitor for a third different and distinct type of alarm condition or could be used for auxiliary purposes to detect the temperature of a boiler or some similar condition not necessarily amounting to an emergency. If it were desired that the detector 215 sense the condition but not indicate an actual emergency, the connection between node 197 and node 209 could be broken and the detector 215 used independently of the alarm indicating relay 169. Node 209 is connected through a lead 217 to a third auxiliary detector output node 219. It will, of course, be understood that any number of different and distinct types of alarm detector circuits could be used and connected in the manner shown and any number of each type of detector could also be similarly connected.

The operation of the circuit of FIG. 2 described to this point will now be briefly discussed. The power transformer 51 receives normal alternating current at the inputs 55 and 57 to its primary winding 53. The secondary or high voltage winding 63 receives the transformed voltage and feeds this signal to the inputs 65, 69 of a full wave rectifier 67. The output of the full wave rectifier 67 is fed to output terminals 117 and 149 which are normally connected via relay operated switching means 155 and switch outputs 151 and 153 to provide a DC transmission signal of a first or normal polarity to the output means of block 23. A line current detector circuit 21 includes a photo diode 109 which normally conducts so long as line conditions are normal. When an open circuit or similar fault exists, the photo diode 109 ceases to emit radiation 121 causing the photo transistor 111 to cease conduction. This causes the transistor switch 133 to turn itself on causing the warning light 139 to come on.

A plurality of sensor circuits 187, 203, 215 monitor for various different and distinct types of alarm or emergency conditions and each of which causes its own normally opened switch 189 to close onto a grounded contact 191 in response to the detection of an alarm condition. This completes the current path between a positive voltage terminal 171 and ground causing the energization of a relay coil 169. The energization of the relay coil 169 causes the relay operated switching means 155 to move to its opposite position thereby reversing the polarity of the DC transmission signal supplied to the output means of block 23.

FIG. 2 also includes a low voltage power supply which is used to supply the voltage +V. The low voltage or second secondary winding 221 receives the signal from the primary winding 53 of the power transformer 51 and has one end connected to the first input node 223 of a full wave rectifier 225 and its opposite end is connected to the second input node 227 of the full wave rectifier 225. A first output node 229 is connected to the cathode of a first diode 231 whose anode is connected to the first input node 223 and to the cathode of the second diode 233 whose anode is connected to the second input node 227. The second output node 235 is connected to ground through a lead 237 and is further connected to the anode of the third diode 239 whose cathode is connected to the first input node 223 and to the anode of the fourth diode 241 whose cathode is connected to the second input node 227. The four diodes 231, 233, 239, and 241 are configured to form a full wave rectifier 225, as known in the art, and provide a full wave rectified output signal at the first output node 229. Node 229 is connected to ground through the series combination of a diode 243 whose cathode is connected to the node 229 and whose anode is connected to the positive terminal of a 12-volt emergency standby battery 245 whose negative terminal is grounded. A capacitor 247 is connected across this combination with one plate connected to the output node 229 and the opposite plate connected to ground. Node 229 is also connected to a node 249 through lead 251. Node 249 is connected via lead 253 to the +V power supply terminal 255. Node 249 is also connected through a resistor 257 to a second output node 259. Node 259 is coupled to ground through a capacitor 261 and is connected through a lead 263 to a second power supply terminal which supplies the voltage +V'. The use of these low voltage power supplies will be apparent from a discussion of the circuits of the present invention.

Figure 3:
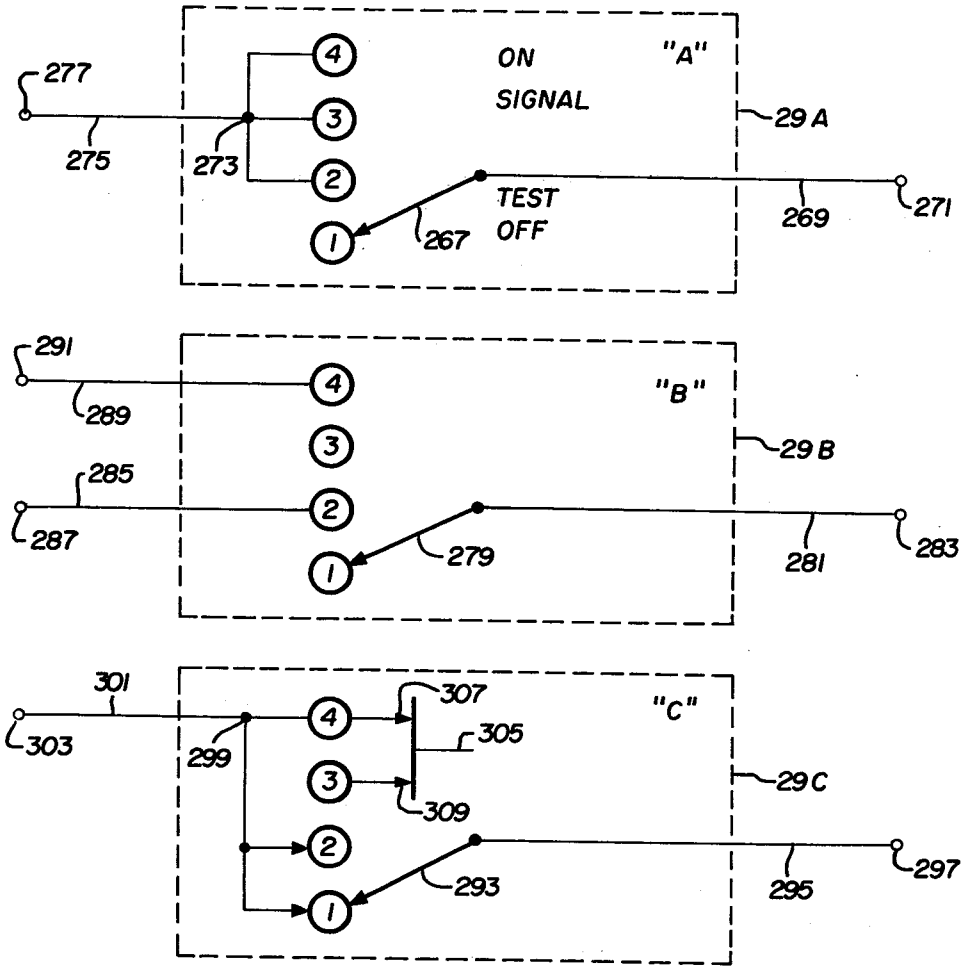
FIG. 3 is a schematic diagram of the manually operable four-position key-activated switch of the present invention.

FIG. 3 illustrates the manually operable, four-position, key-operated switch of block 29 of FIG. 1. A first stage "A" is indicated as being enclosed within the dotted block labeled 29a, a second or "B" stage is indicated as being enclosed within the dotted block 29b and a "C" stage is shown as being enclosed within the dotted block labeled 29c. The stage 29a includes a manually positionable switching arm 267 which is connected via lead 269 to a terminal 271. The second, third and fourth contacts of stage 29a are commonly coupled together at node 273 which is connected via lead 275 to point 277. As indicated by the labels in the block of stage 29a, the first contact corresponds to the "off" position; the second contact corresponds to the "test" position; the third contact corresponds to the "signal" position and the fourth and last contact corresponds to the "on" position. The similarly numbered contacts in stages 29b and 29c correspond to the same positions and it will be understood that when the position of the switch is manually changed, all of the switch arms move together to the same corresponding contact of their stages.

Stage 29b has a switching arm 279 connected via lead 281 to terminal point 283. The number two contact is connected via lead 285 to junction 287 and the fourth position contact is connected via lead 289 to a junction 291. Stage 29c has its switching arm 293 connected via lead 295 to junction terminal 297. Additionally, the first, second and fourth contacts are commonly coupled together at node 299 which is connected via lead 301 to junction 303. Even further, stage 29c includes a manually operable coding key switch 305 which is normally closed against a first contact point 307 which is connected to the fourth position contact and a second contact point 309 which is connected directly to the third contact of stage 29c. The use of the coding key and the operation of the switch of FIG. 3 in its various positions will be described with reference to the circuits hereinafter described.

Figure 4:
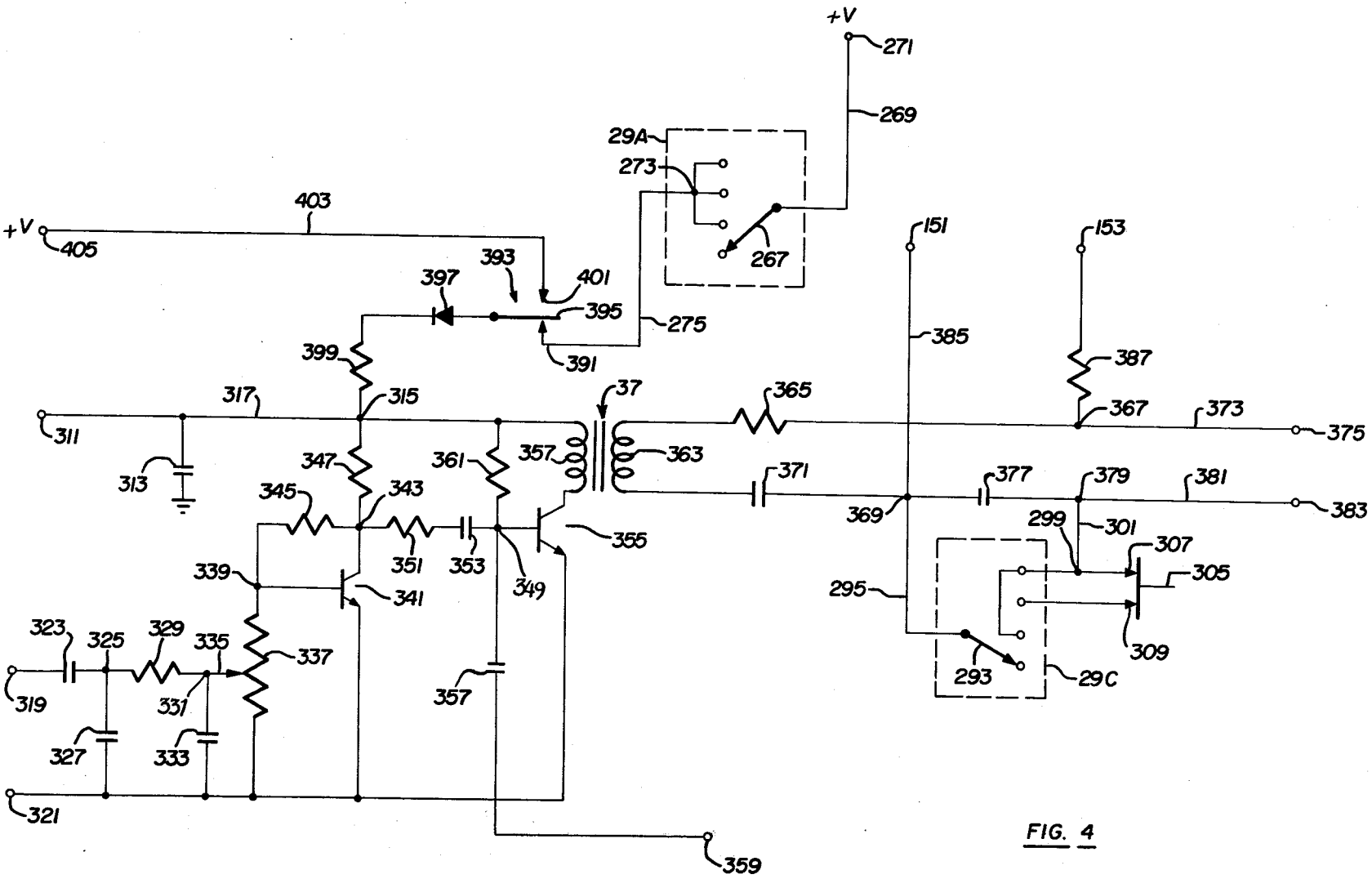
FIG. 4 is an electrical schematic diagram of the high gain audio amplifier, transformer, and output circuitry of FIG. 1, together with a second relay-operated switch and two sections of the four-position switch of FIG. 3.
Figure 6:
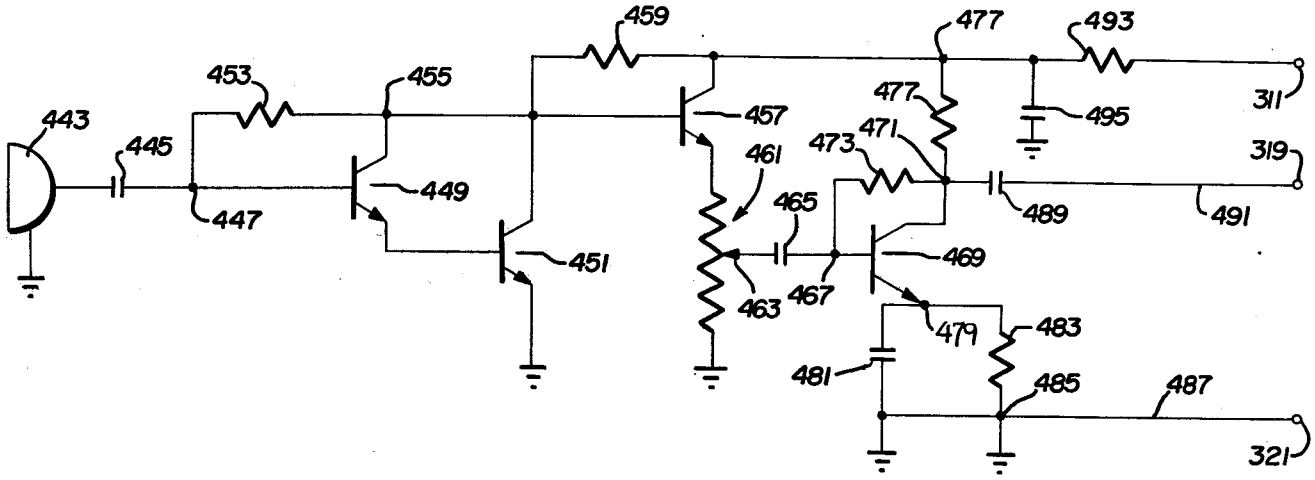
FIG. 6 is an electrical schematic diagram of one of the plurality of microphones represented by block 33 of FIG. 1.

FIG. 4 shows a schematic circuit diagram of the high gain audio amplifier of block 35, the audio transformer of block 37, the output means of block 23, and a portion of the relay means of block 25 of FIG. 1 together with stage 29a of FIG. 3. For normal operation, the power junction 311 of FIG. 4 connects to the correspondingly numbered power junction of the microphone circuit of FIG. 6 to be hereinafter described. Junction 311 is connected to ground through capacitor 313 and to a node 315 via lead 317. The signal output junction 319 corresponds to the similarly numbered junction which serves as the signal output to the microphone circuit of FIG. 6 and the grounded junction 321 similarly corresponds to the grounded junction of the microphone circuit. Junction 319 is coupled through a capacitor 323 to a node 325. Node 325 is coupled to ground through a filter capacitor 327 and through a resistor 329 to a node 331. Node 331 is coupled to ground through a second filter capacitor 333 and to a potentiometer or trim pot arm 335 which can be manually adjusted up and down the variable resistor or trim pot 337 to alter the sensitivity of the circuit. The signal from the microphone circuit of FIG. 6 is inputted between junctions 319 and 321 and the combination of resistor 329 and the capacitors 327, 331 serve as a band pass filter network for the incoming signal. The adjustable resistor 337 has one terminal connected to ground and its opposite terminal connected to node 339. Node 339 is connected to the base of a transistor 341 whose emitter is connected directly to ground and whose collector is connected directly to a node 343. Base node 339 is connected to the collector node 343 through a resistor 345. Collector node 343 is connected to the node 315 through a resistor 347 and to a node 349 through the series combination of a resistor 351 and a capacitor 353. Node 349 is directly connected to the base of a transistor 355 whose emitter is connected directly to ground and whose collector is connected to node 315 through the primary coil 357 of the audio transformer 37. Node 349 is also connected through a capacitor 357 to the signal injector output junction 359 which will hereinafter be described. Node 349 is also connected through a resistor 361 to node 315.

The signal from the microphones is received at the input 319, 321 and filtered by the network comprising resistor 329 and the capacitors 327, 333 before being fed to the high gain audio amplifier circuit comprising transistor 341. The output is fed via transistor 355 to the primary winding 357 of the audio transformer 37. The secondary coil 363 of the audio transformer 37 has one end connected to a node 367 through resistor 365 and its opposite end connected to a node 369 through a capacitor 371. Node 367 is connected via lead 373 to the output terminal 375 of the output means of block 23 of FIG. 1. Node 369 is connected through a capacitor 377 to a node 379 and thence via lead 381 to a second output terminal 383 of the output means of block 23. Output terminal 375 connects directly to the first transmission line 15 and the second output terminal 383 connects directly to the second transmission line 17 of FIG. 1. Node 369 is connected via lead 385 to junction 151 which connects to lead 161 of the relay operated switching means 155 of FIG. 2. Similarly, node 367 is connected through resistor 387 to the switch output junction 153 of the relay-operated switch 155 of FIG. 2.

Stage 29c is connected between nodes 369 and 379 as indicated in FIG. 4. The switching arm 293 is connected via lead 295 to node 369 which represents the junction 297 of FIG. 3. The fourth switch position contact node 299 is connected via lead 301 to node 379 which corresponds to junction 303 of FIG. 3 and the manually-operable coding key 305 is shown in a closed position over the contacts 307 and 309. The operation of this portion of the circuit will be described in greater detail hereinafter.

Under normal conditions, power to the audio system is supplied from the +V source at power terminal 271. Terminal 271 connects via lead 269 and switching arm 267 to the fourth contact of stage 29a when the switch 29 has been moved to the "on" position. The fourth contact is connected to node 273 and then via lead 275 to the first switch contact 391 which corresponds to junction 277 of stage 29a of FIG. 3. A second relay-operated switch 393 normally has its switching arm 395 closed on the first contact 391 and its opposite end connected to the anode of a diode 397 whose cathode is connected through a resistor 399 to node 315. As long as the manually operated four-position switch of block 29 is in the "on" position, power is supplied from the power terminal 271 to the node 315 through stage 29a and the second relay operated switch 393.

The switch of block 29 may, however, be turned to the "off" position to remove the power from the audio system and insure the privacy of those located at the remote station 11. The second relay-operated switch 393, however, insures that if the relay coil 169 of FIG. 2 is energized in response to the detection of an emergency or alarm condition, the switch arm 395 will be repositioned to engage contact 401 which is connected via lead 403 to power terminal 405 which is supplied from the power source +V. Once the emergency condition has been detected and the relay coil 169 is energized, the closure of the switching arm 395 on the contact 401 provides power from the power terminal 405 to the junction 315 to energize the microphone system and the audio amplifier even though the manually operable switch remains in the "off" position. This is a particularly useful feature of the present invention which allows those located at the remote station 11 to enjoy their privacy while still insuring that the audio detection portion of the circuit will be enabled if an alarm condition is detected.

Figure 5:
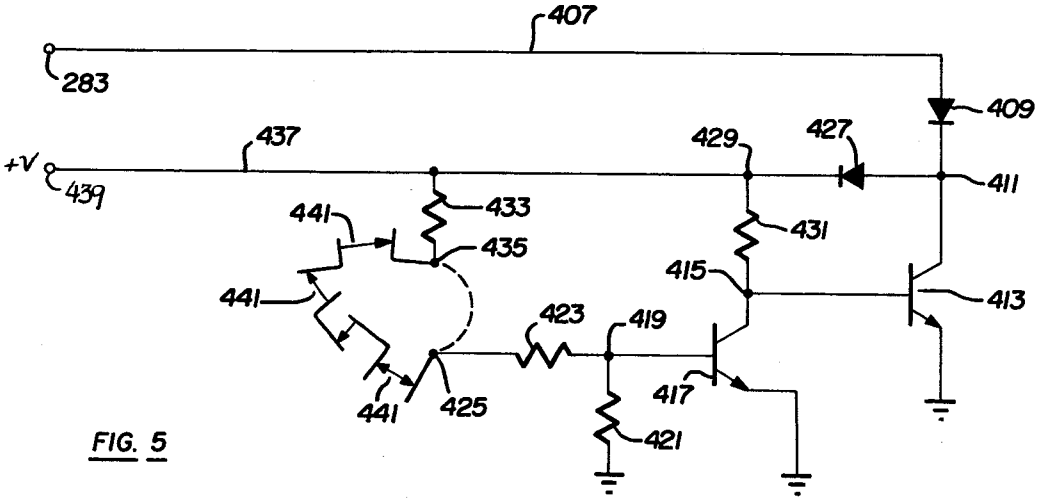
FIG. 5 is an electrical schematic diagram of the closed-loop perimeter security circuit of the present invention.

FIG. 5 represents the closed loop perimeter security circuit of block 31 of FIG. 1. More specifically, node 283 corresponds to the similarly numbered node on stage **29*b* of FIG. 3 and on the circuit of FIG. 2. Node 283 is connected via lead 407 to the anode of a diode 409 whose cathode is connected to a node 411. Node 411 is connected directly to the collector of a first transistor 413 whose emitter is connected directly to ground. The base of the transistor 413 is connected to a node 415 which represents the collector node of a second transistor 417. The second transistor 417 has its emitter connected directly to ground and its base connected to a base node 419. Node 419 is connected to ground through a resistor 421 and is also connected through a resistor 423 to a first closed loop terminal 425. Node 411 is connected to the anode of a diode 427 whose cathode is connected to a node 429. Node 429 is connected through a resistor 431 to the node 415; is connected to the second closed loop terminal 435 through a resistor 433; and is connected via lead 437 to a power terminal 439 which is supplied from the source of potential +V. Any number of normally closed switches 441 may be connected in a serial manner between the closed loop terminals 425 and 435**. These switches may be used to protect the perimeter of the premises and to insure that all windows, doors and other access areas remain closed. It could, for example, involve the use of the frequently used McCullough loop-type of normally closed circuits.

In operation, a closed loop is established between the power source of terminal 439 and ground via lead 437, resistor 433, the loop of switches 441, resistor 423, and the normally "on" transistor 417. The transistor 413 is held normally "off" by the pull up resistor 431 so that no current flows in the lead 407. When the switch stage **29*b* is in the "on" position, the arm 279 is in contact with the fourth switch position which, in turn, is connected via lead 289 and terminal 291 in FIG. 3, which correspond to lead 177 and junction 173 in FIG. 2 to the low end of the relay coil 169. If any of the normally closed switches 441 in the loop between the terminals 425 and 435 are broken, transistor 417 switches off causing the voltage at node 415 to rise since it is connected through resistor 431 to the source of potential at terminal 439 thereby causing transistor 413 to switch on. This provides a current path between the voltage terminal 171 of FIG. 2 through the relay coil 169, switching stage 29*b*, lead 407 and transistor 413 to ground. This causes the energization of the relay coil 169 which triggers the polarity reversal via switch 155** to indicate the existence of an alarm condition.

Additionally, when the four-position switch of block 29 is in the "test" position, the switching arm of stage **29*b* moves to the second contact position to complete a current path via lead 285 and node 287, which correspond to lead 145 and node 137 of FIG. 2, so as to connect the warning light 139 and the voltage terminal 141 into the closed loop circuit. So long as the series of switches 441 of the closed loop remain closed and transistor 417 conducts, there will be no warning light indicating that the integrity of the closed loop circuit is intact. If, however, one of the switches 441 is open, transistor 417 turns off causing transistor 413 to turn on. This establishes a current path between the terminal 141 to ground via warning lamp 139, stage 29*b*, and the now conducting transistor 413 thereby energizing the warning light and signaling that the loop has been broken. This enables an operator at the remote location 11 to test the integrity of the loop at the remote location by merely moving the switch of block 29** to the "test" position.

The microphone circuit of FIG. 6, which corresponds to one of the many microphones which is represented generally by the block 33, will now be described in detail. A pick-up device or transducer 443 is connected through the capacitor 445 to a node 447. Node 447 is connected directly to the base of a first transistor 449 of a Darlington pair comprising transistors 449 and a second transistor 451. The emitter of the first transistor 449 is connected to the base of the second transistor 451 whose emitter is connected directly to ground. The base node 447 is connected through a resistor 453 to a collector node 455 which is connected directly to the collectors of transistors 449 and 451. Node 455 is also connected directly to the base of a transistor 457 whose collector is connected through a resistor 459 back to the node 455. The emitter of transistor 457 is connected to a trim pot or variable resistor 461 whose opposite end is connected to ground. A movable potentiometer tap or arm 463 can be moved to various points along the resistor 461 to vary the sensitivity of the amplifier as required by the location in which the transducer 443 is placed. The arm 463 is coupled through a capacitor 465 to a node 467. Node 467 is connected directly to the base of the transistor 469 whose collector is connected directly to a node 471. The base node 467 is connected to the collector node 471 through a resistor 473 and the node 471 is connected through a resistor 475 to a node 477 which connects directly to the collector of the transistor 457. The emitter of the transistor 469 is connected directly to the node 479 which is coupled through a capacitor 481 to ground and to one end of a resistor 483 whose opposite end is connected to a grounded node 485. The grounded node 485 is connected via lead 487 to the grounded junction 321 of FIG. 4. A collector node 471 is coupled through a capacitor 489 and a lead 491 to the signal input node 319 of FIG. 4. The microphone system receives its power from the power node 311 of FIG. 4 which is connected through a resistor 493 to the node 477. Node 477 is also coupled to ground through a capacitor 495.

As mentioned previously, transistors 449 and 451 form a Darlington pair and the sensitivity of the microphone amplifier may be selectively varied by manually positioning the wiper arm 463 with respect to the trim pot resistor 461. The capacitor 465 serves as a filter capacitor and the resistor 493, capacitor 495 combination provides a secondary filter for the input power. The output of the transistor 469, which is taken from node 471, presents an extremely high impedance so that many microphones may be connected in parallel to the single signal input 319 of FIG. 4.

The signal injector circuitry of block 39 of FIG. 1 will now be described in detail with reference to FIG. 7. The negative supply terminal 497 is connected to the source of potential $-V_1$ and is connected via lead 499 to the collector of an enabling transistor 501. The alarm conditin input terminals 195, 207 and 219 correspond to the similarly numbered terminals of the sensor circuits of FIG. 2. Lead 207 is connected directly to node 503 via lead 505 whereas terminal 195 is connected to a node 507 through a lead 509 and terminal 219 is connected to a node 511 through a lead 513. Node 511 is connected to the cathode of a diode 515 whose anode is connected directly to node 503 and node 507 is connected directly to the cathode of a diode 517 whose anode is connected directly to node 503. Node 503 is connected through a base resistor 519 to the base of transistor 501 whose collector is connected directly to a reference node 521. The transistor 501 remains in a nonconductive state until one of the input terminals 195, 207 or 219 goes to ground by the operation of one of the corresponding alarm sensing circuits 187, 203, 215, detecting an alarm condition. When any of the sensors of block 27 detect an alarm condition, node 503 goes to ground and causes transistor 501 to switch to a conductive state thereby connecting the node 521 with the negative source of potential via lead 499.

Node 521 is, in effect, a reference node or lead to which many further connections will be made. First and second oscillator circuits 523 and 525 are connected to the reference 521. The first oscillator 523 includes a unijunction transistor (UJT) 527 which has its emitter directly coupled to a node 529. Node 529 is coupled to the base node 521 through a capacitor 531 and through a resistor 533 to a source of potential $+V_2$. Base one of the UJT 527 is connected through a resistor 535 to the source of potential $+V_2$ while base two is connected directly to output node 537. Node 537 is connected to the base node 521 through a resistor 539 and via lead 541 to the clock input of a first bistable means such as a J-K flip-flop 543. The "set" input of the flip-flop 543 is coupled through a capacitor 545 to the base input 521 and the clear input is directly connected via lead 547 to the reference node 521.

In operation, when the transistor 501 is switched on by the presence of ground at node 503, indicative of the existence or detection of an alarm condition by the sensors of block 29, the reference node 521 will go more negative. Initially, the UJT 527 has its emitter reverse biased and hence is nonconducting. As the capacitor 531 is charged through the resistor 533 from the source of potential $+V_2$, the emitter voltage rises exponentially toward the supply voltage $+V_2$. When the emitter voltage reaches some peak value, the emitter becomes forward biased and the dynamic resistance between the emitter and base one drops to a low value. Capacitor 531 will then discharge through the UJT 527 via the emitter and the base two output. After the discharge, the voltage again builds on the capacitor 531 until the peak voltage at which discharge occurs is again reached. In this manner, the UJT 527 provides an output at node 537 which is supplied to the clock input of the flip-flop 543 at a rate determined by the time constant of resistor 533 and capacitor 531. In the particular example, the time constant is set so that the "Q" output which is taken from lead 549 is alternately high for 15 seconds and then low for 15 seconds and so on. The "Q" output of the J-K flip-flop 543 is connected via lead 549 to the set input of the second J-K flip-flop 551 so as to alternately enable and then disable the flip-flop 551 during successive 15-second intervals.

A second oscillator circuit 525 includes a second UJT transistor 553 whose time constant is set so as to provide clocking pulses at one second intervals to the clocking input of the second J-K flip-flop 551.

Specifically, UJT 553 of the second oscillator 525 has its emitter directly coupled to a node 555. The node 555 is coupled through a capacitor 557 to the reference node 521 and through a resistor 559 to the soure of potential $+V_2$. Base one of the UJT 553 is connected through a resistor 561 to the reference source $+V_2$. Base two is directly connected to an output node 563 which is connected through a resistor 565 to the reference node 521 and via lead 567 to the clock input of the J-K flip-flop 551. The operation of the oscillator 525 is similar to that of oscillator 523 except that it operates at one second intervals instead of at 15 second intervals. The "$\bar{Q}$" output of the second J-K flip-flop 551 is connected to the anode of a diode 569 whose cathode of coupled to an output node 571. Basically, signals outputted from the "$\bar{Q}$" output of flip-flop 551 will appear as a fifteen second series of one second duration, substantially rectangular pulses followed by a 15 second period of no signals and this would be repeated so long as the transistor 501 remains on.

Output node 571 is connected through a first relatively small value capacitor 573 to the node 511 and through a second relatively large value capacitor 575 to node 507. The capacitors are able to store the output from the flip-flop 571 depending on the value of the capacitor and the signal at the nodes 507 and 511. If, for example, a hold-up signal were to be presented to node 207, neither of the capacitors 575 or 573 would have any effect on the output at 571 so that the output signal would be supplied through resistor 577 to the input node 579 of a tone generator circuit including a UJT 581. The tone generator circuit has the emitter of UJT 581 directly coupled to the node 579 which is coupled through a capacitor 583 to the reference node 521. Base one of the UJT 581 is coupled through a resistor 585 to the $+V_2$ source of potential and base two is connected through a resistor 587 to the reference node 521. Node 579 is connected through a resistor 589 to a base node 591 of an output transistor 593. Base node 591 is connected through a resistor 595 to the reference node 521 and the emitter of the transistor 593 is directly coupled to the reference node 521. The collector of transistor 598 is directly connected to the collector output node 597 which is connected via lead 599 to the signal injection output terminal 359 of FIG. 4. Output node 597 is connected through a resistor 601 to a source of potential $+V_1$. The $+V_1$ source of potential is connected through a resistor 603 to an output voltage supply node 605 from whence the supply voltage $+V_2$ is taken. The $+V_2$ voltage is maintained by a Zener diode 607 which has its anode connected directly to a node 609 and its cathode connected to node 605. A capacitor 611 is connected in parallel with the Zener diode 607 and has one plate connected to the output node 605 and the other plate connected to the node 609. Node 609 is then directly connected via lead 613 to the reference node 521.

The UJT 581 is part of a one kilocycle tone generator and assuming that a hold-up signal is present at input 207, the signal outputted from J-K flip-flop 551 would be relatively unchanged by the capacitors 573 and 575 so that the output node 597 of transistor 593 would output a series of "beeps" which would correspond to the existence of a hold-up condition. If a fire detection or fire alarm signal were present at input 195, the lower plate of capacitor 575 would be grounded and the pulses outputted from flip-flop 551 would build on the capacitor 575 to cause a stair-step signal to appear at node 571. As this signal is applied to the tone generator including UJT 581, output node 597 of transistor 593 would pass a "siren" tone which would constantly increase in frequency for 15 seconds in a stair-step manner and then die off until triggered again by the next set of stair-step signals being stored on the capacitor 575.

If, on the other hand, an alarm signal were to appear at terminal 219, the lower plate of capacitor 573 would be grounded but since the capacitor 573 is of much smaller value than capacitor 575, the signals outputted from flip-flop 551 would not be able to build in a stair-step fashion but would only start to build before being discharged through the UJT 581. This would cause an output signal at node 597 of transistor 593 which possessed a distinctive "warbling" effect, as known in the art. As each of these separate and distinct types of alarm conditions were detected, a distinctive signal would be outputted from the tone generator and injected via terminal 359 into the circuit of FIG. 4. This audio signal would be superimposed onto the DC transmission signal via the transformer 37 and the output means of block 23 so that the operator at the central station would be able to differentiate between various types of alarm conditions at the remote site 11.

The operation of the various circuits of the remote station 11 will now be discussed in general terms with respect to FIGS. 1–7. The four-position switch of FIG. 3 may be placed in the "off" position to disable the audio circuits and insure the privacy of the persons located at the remote station 11. In the "off" position, the audio system is disabled and the closed loop perimeter security circuit of FIG. 5 is disabled, but the other alarm sensors 183, 203 and 215 remain intact. If one of these detectors senses an alarm condition, the relay coil 169 will be energized causing the polarity of the DC transmission signal supplied to the output means 23 to be reversed indicating that an alarm condition has occurred. Additionally, the energization of the relay coil 169 causes the second relay-operated switch 393 to provide auxiliary power to the audio system thereby overriding the "off" position and bringing the audio monitoring circuits into operation.

When the switch is in the "test" position, as previously described, the integrity of the closed loop circuit of FIG. 5 can be tested by monitoring the warning light 139 of FIG. 2.

When the switch 29 is in the "signal" position, the switch arm 293 completes the path to the third position contact of stage 29*c*. This places the manually operated coding key 305 into series with the output circuitry of block 29 so that as the operator at the remote station 11 opens and closes the switch 305 on the contacts 307 and 309, he intermittently breaks the transmission of the DC signals over the lines 15, 17 and this coded message can be read by an operator at the central monitoring station 13.

When the switch 29 is in the "on" position, all of the alarm sensing circuits at the remote station 11 are enabled. As previously discussed, if any of the alarm condition sensors of block 27 detect an alarm condition, the relay coil 169 will be activated to trigger a reversal of the polarity of the DC signal appearing at the output terminals 375, 383. Similarly, a break in the normally closed perimeter security loop of FIG. 5 will cause the energization of relay coil 169 and a corresponding alarm-indicating polarity reversal.

In addition, the audio sounds originating at the remote location 11 will be sensed by the microphone of block 33 and the audio signals will be superimposed onto the DC transmission signal via the audio transformer 37 and the output means of block 23 and transmitted therewith to the central monitoring station 13 over the transmission lines 15, 17. Even further, the signal injector circuits of FIG. 7 can inject different and distinct audio tone signals into the amplifier 35, transformer 37 system causing additional audio signals to be superimposed onto the DC transmission signal so that the operator at the central location can differentiate between the various types of alarms.

With this discussion of the system of the remote station 11 and of its operation in mind, a detailed description of the circuits of the central monitoring station 13 will be described. The transmission lines 15, 17 terminate at input terminals 615, 617, respectively. Input 615 is connected directly to a switch contact 619 which is normally interconnected to a second switch contact 621 by a normally closed manually positionable coding key 624. The contact 621 is directly connected to a first input node 623 and the terminal 617 is directly connected to a second input node 625. The coding key 624 serves a function similar to the coding key 305 at the remote station 11 and allows the operator at the central station 13 to send coded messages to the remote station 11 by making and breaking the path between contacts 619 and 621. These coded signals can be read at the remote location since the photo-optical coupler 107 will sense the intermittent open circuit conditions to alternately turn the warning lamp 139 off and on as the switch 624 is opened and shut at the central station 13.

The line supervision circuit of block 41 includes a full wave rectifier circuit 627 whose first input 629 is directly connected to the first input node 623 while the second rectifier input 631 is directly connected to the second input node 625. The first output of the full wave rectifier 627 is taken from output node 633 and the second output is taken from node 635. Node 633 is connected directly to cathode of a first rectifying diode 637 whose anode is connected directly to the first input node 629 and to the cathode of a second rectifying diode 639 whose anode is connected directly to the second input node 631. The second output node 635 is connected directly to the anode of a third rectifying diode 641 whose cathode is connected directly to the first input node 629 and to the anode of a fourth rectifying diode 643 whose cathode is connected directly to the second input node 631. The four diodes 637, 639, 641 and 643, comprise a typical full wave rectifier as known in the art. The first output node 633 is connected through a resistor 645 to a node 647 and the second output 635 of the full wave rectifier 627 is connected via lead 649 to a node 651. A Zener diode 653 has its cathode connected to node 647 and its anode connected to node 651. Node 647 is connected through a resistor 655 to the input node 657 of a photo-optical coupler 659. A protective diode 661 is connected across the photo-optical coupler 659 so that its cathode is connected to the input node 657 and its anode is connected to node 651. The photo-optical coupler 659 includes a photo diode or light-emitting diode 663 which responds to the current normally flowing through the diode to emit some form of light or radiation 665. So long as the input nodes 623, 625 are receiving the DC transmission signal from the transmission lines 15, 17, a current will continuously flow through the photo diode 663 causing it to emit radiation 665. The emitted radiation 665 will keep a photo detector or photo transistor 667 in the "on" or conductive condition. The photo transistor 667 has its emitter directly coupled to ground and its collector coupled to collector node 669. The node 669 is connected to a source of potential $+V_3$ through a resistor 671. The node 669 is also connected through a resistor 673 to the base of a normally nonconducting transistor 675. The emitter of transistor 675 is connected directly to ground and the collector is connected directly to the collector output node 677. Node 677 is connected through a fault indicator light 679 to the $+V_3$ source of potential. Furthermore, node 677 is connected to the cathode of a diode 681 whose anode is connected to a speaker input node 683 which is connected directly to an accoustical transducer such as a horn or speaker 685.

In operation, so long as there are no open circuit or short circuit conditions which would interrupt the transmission of the DC signal to the inputs 623, 625, current will continue to flow in the photo diode 663 causing the photo transistor 667 to remain in a conductive state. This keeps node 669 at approximately ground thereby biasing transistor 675 in the non-conductive state. If, however, an open circuit or short circuit were to occur, current would cease to flow in photo diode 663 and it would cease to emit radiation 665. This would cause the photo transistor 667 to turn off, thereby allowing the voltage at the base of transistor 675 to rise since the base is connected through resistors 673 and 671 to the source of potential $+V_3$. When the transistor 675 turns on and switches to a conductive state, a conductive path is established from the $+V_3$ source of potential through the fault indication light 679 to ground through the now-conducting transistor 675. The operator at the central station 13 is able to observe the fault indicator light 679 and knows that an open circuit or short circuit condition has been detected. Additionally, the operator's attention may be drawn to the warning light 679 since the condition of transistor 675 may also be used to initiate the horn 685 which triggers when node 677 drops low with the conduction of transistor 675.

The alarm monitoring circuit of block 45 of FIG. 1 will now be described in detail. The first input node 623 is connected via lead 687 to an input node 689 to a second photo-optical coupler 691 whose other input is taken from input node 693 which is connected to the cathode of a diode 695 whose anode is connected directly to the second input node 625. A protective diode 697 is connected across the photo-optical coupler 691 with its cathode connected directly to node 693 and its anode connected directly to node 689, as known in the art. Input node 693 is connected directly to the anode of a photo diode or light emitting diode 699 whose cathode is connected to the second input node 689. The photo diode 699 will emit light or some other form of radiation 701 whenever current passes through the photo diode 699. Under normal conditions, the polarity of the transmitted DC signal is such that it is blocked by diode 695 so that the photo diode 699 is normally nonconductive so that no radiation 701 is emitted. This normally maintains the photo detector or photo transistor 703 in a normally "off" or nonconductive state. The photo transistor 703 has its collector connected directly to the $+V_3$ source of potential and its emitter directly coupled in a Darlington configuration to the base of a transistor 705. The collector of transistor 705 is connected directly to the $+V_3$ source of potential and the emitter is directly connected to output node 707. Output node 707 is connected to ground through a resistor 709 and through a second resistor 711 to node 713. Node 713 is connected to ground through a resistor 715 and to the gate of a silicon-controlled rectifier (SCR) 717 whose cathode is connected to the anode of a protective diode 719 whose cathode is connected directly to ground. The anode of the SCR 717 is connected to a node 721. Node 721 is connected to the $+V_3$ source of potential through an alarm condition indicating light 723; to the cathode of a diode 725 whose anode is connected to the horn input node 683; and to a first reset switch contact 727. A second reset switch contact 729 is connected directly to ground and a normally open switch 731 is positioned above the contacts 727 and 729 such that its closure will complete a conductive path therebetween.

In operation, the alarm monitoring circuit will be turned off so long as the polarity of the incoming DC signal remains normal. If an alarm condition is sensed at the remote station 11 and the polarity is reversed as an indication thereof, the diode 695 will pass the reversed polarity signal causing the photo diode 699 to conduct. The conduction of the photo diode 699 in response to the existence of an alarm condition, will cause the normally nonconductive photo transistor 703 to switch to a conductive state thereby turning on the second transistor 705 of the Darlington pair comprising transistors 703, 705. The conduction of transistor 705 connects the source of potential $+V_3$ to node 707 causing the voltage at the gate of the SCR 717 to rise thereby triggering the SCR 717 into conduction. The diode 719 is located at the cathode of the SCR 717 to prevent false alarm signals such as may be generated from noise spikes and the like. Once the SCR 717 is gated, a path is established from the $+V_3$ source of potential to ground through the alarm indicating light 723 and the SCR 717. Similarly, when the node 721 goes toward ground, the horn 685 will be triggered to call the operator's attention to the existence of an alarm condition. Since the SCR 717 is a self-latching device, the alarm indicating horn 685 and the alarm indicating light 723 will remain on indefinitely. Once the alarm producing condition is alleviated at the remote location, the operator can manually close the switch 731 on the contacts 727, 729 thereby grounding node 721 to unlatch the SCR 717 and restore the alarm monitoring circuit to its normal nonconducting state. It will remain in this inactive state until the next polarity reversal again triggers it into operation.

The photo-optical coupler 659 and 691 of the line supervision circuit of block 41 and the alarm monitoring circuit of block 45 are particularly important in that they provide a much needed electrical insulation so that current surges, voltage spikes and the like occurring on the transmission lines 15, 17, as by bolts of lightening and the like, will be totally isolated from the basic alarm circuitry thereby preventing false alarms and damage to the delicate electrical components of the alarm circuitry.

The third and last circuit of the central monitoring station 13 is the audio monitoring circuitry of block 47. The first input node 623 is coupled through a DC blocking capacitor 733 to one end of the primary winding 735 of an isolation transformer 737 whose opposite end is connected directly to the second input node 625. The isolation transformer 637 performs a function similar to that of the photo-optical couplers 659 and 691 and serves to isolate the secondary portion of the audio monitoring circuit from transmission line irregularities and the capacitor 733 serves to block the DC signal so that only the audio portion which was superimposed at the output means of block 23 is passed to the primary winding 735. The secondary winding 739 has one end connected to a node 741 and its opposite end connected to a first input of a normal audio amplifier 741. The other input of the audio amplifier 741 is taken via lead 743 from node 741 and the output of the audio amplifier is supplied via lead 745 to the input of the audio gate 747. Node 741 is also connected to the input of a threshold amplifier 749 whose output is connected to the gating input of the audio gate 747 via lead 751. The threshold amplifier 749 may be varied, as known in the art, to pass only those signals above a predetermined voltage level. This gating signal will trigger the audio gate 747 to pass the signals outputted from the audio amplifier 741 via lead 753 to the speaker 755 so that the speaker 755 will render audible only those audio signals above a certain predetermined level set by the threshold amplifier 749.

In operation, the predetermined level of the threshold amplifier may be adjusted by the operator at the central monitoring station 13 so that if the switch of block 29 is in the "on" position at the remote station 11, and the powered microphones detect a sound, such as breaking glass or the like, originating at the remote location 11, then the audio signal superimposed onto the DC transmission signal via the audio transformer of block 37 and the circuitry of output means 23, then the audio signal will be received by the isolation transformer 737 and if the audio signal is above the predetermined level adjustably established by the threshold amplifier 749, the signal will be passed by the audio gate 747 and rendered audible by the speaker 755 so that the operator will actually be able to listen to the noises originating at the remote location 11.

Even if the switch of block 29 were in the "off" position, as described previously, the detection of an alarm condition would cause the relay-operated switch 395 to power the audio system to allow the operator to listen to the sounds originating at the remote location.

Figure 7:
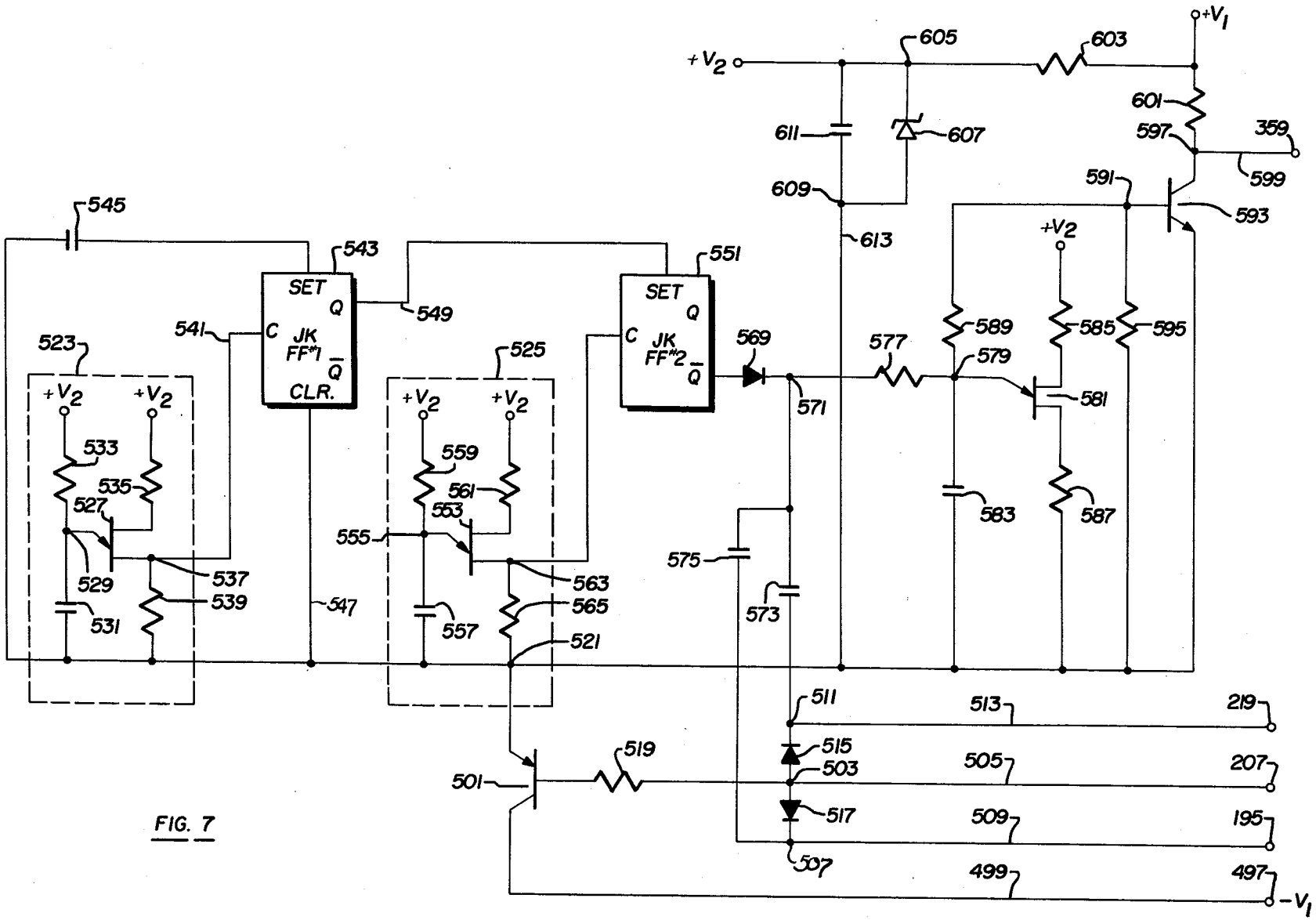
FIG. 7 is an electrical schematic diagram of the signal injection system of block 39 of FIG. 1.
Figure 8:
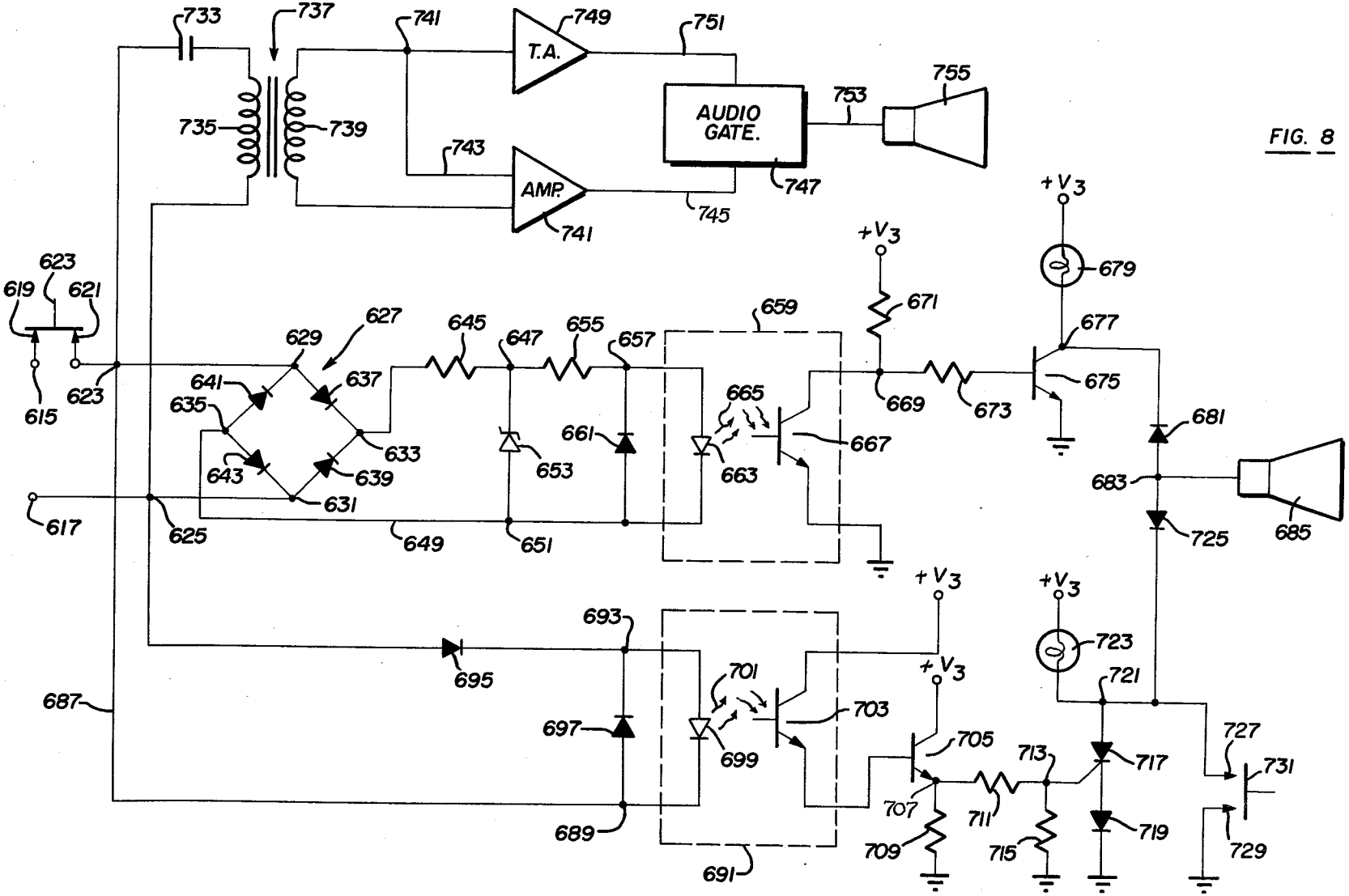
FIG. 8 shows an electrical schematic diagram of the central monitoring station of FIG. 1.

Additionally, the audio tone signals which were superimposed upon the DC transmission signals by the signal injector of FIG. 7 will be received by the transformer 737 and rendered audible by the speaker 755 so that an operator located at the central location 13 will be able to hear and distinguish between the various different and distinct generated tones to determine the nature of the alarm condition existing at the remote location 11. As described previously, the tone generator operates for 15 seconds to send its predetermined tone and then is silenced for 15 seconds. This period of silence allows the operator to listen to the sounds originating at the remote location and detected by the microphones of block 33 as a further aid in determining the exact nature of the emergency and the current state of affairs at the remote location 11.

In summary, the improved system of the present invention provides excellent isolation characteristics at the central monitoring station which prevents false alarms and damage to the highly sophisticated electrical equipment at the central monitoring station 13. Since damage to the equipment may result in a temporary loss of protection to one or more areas, these enhanced isolation characteristics make the overall system much more reliable and increase customer confidence in the system. The solid state circuits employed at the central location lowers the cost of the circuitry, decreases its response time, and lessens the need for maintenance. The combination of the audio capabilities which allows the operator to actually listen to the sounds originating at the remote location 11 and the signal injector feature for differentiating between various types of alarm conditions, and the two-way ring-back capability results in a greatly improved system over any heretofore known in the prior art.

With this detailed description of the specific circuitry used to illustrate the prime embodiment of the present invention and the operation thereof, it will be obvious to those skilled in the art that various modifications may be made in the present circuits, various components may be substituted for one another and the values may be altered to suit the desired applications, and many other modifications and alterations may be made without departing from the spirit and scope of the present invention which is limited only by the appended claims.

I claim:

1. A security alarm system comprising, in combination, a remotely located station to be protected, a central monitoring station and electrical transmission lines coupled therebetween, said remote station including output means coupling said remote station to said transmission lines, means for generating a DC transmission signal having a first normal polarity, first relay responsive switching means normally coupling said generated DC signal of said first normal polarity to said output means, a line current detector including a photo-optical coupler having a photo diode coupled between said generating means and said first switching means, said photo diode being responsive to the normal passage of current therethrough for maintaining its phototransistor in a first conductive state and responsive to the absence of current therethrough to switch its phototransistor to a second conductive state, indicator means at said remote station responsive to said second conductive state for providing a visual indication of the failure to transmit said DC transmission signal, a plurality of alarm condition sensors normally maintaining a first normal condition but triggerable to a second alarm condition in response to the detection of said alarm condition, a normally de-energized relay responsive to said second alarm condition for energizing its coil to switch said first relay responsive switching means to reverse the normal polarity of the DC signal supplied to said output means, a manually operable multipositionable switch located at said remote station, said switch being positionable to at least an "on" and an "off" state, microphone detector means including a plurality of individual microphones located about said remote station for detecting audible sounds originating therein, each of said microphones having its own amplifying means and means for adjusting its individual sensitivity, said microphone detector means further including a high gain amplifier for further applying the AC outputs of said microphones, a transformer means for superimposing the amplifier AC audio signal onto the DC transmission signal at said output means, means responsive to said manually-operable switch being in the "on" position for supplying necessary power to said microphones, supplemental second relay responsive switching means responsive to the energization of said relay means in response to the detection of an alarm condition for supplying the necessary power to said microphones even if said manually-operable switch is in the "off" position, closed loop means activated when said manually-operable switch is in said "on" position, for maintaining a first closed circuit state so long as no part of the perimeter security loop is broken but responsive to a break in the security loop for switching to a second closed circuit state, said relay means being further responsive to said second closed circuit state for energizing the relay coil to reverse the polarity of the DC transmission signal supplied to said output means, said central monitoring station comprising a line supervision circuit including a full wave rectifier coupled to said transmission lines for providing a continuous DC signal to a photo-optical coupler for isolating said central station, said photo-optical coupler having a photo diode coupled in series with said full wave rectifier, said photo diode being normally responsive to the presence of DC current for maintaining its phototransistor in a first state but being responsive to the absence of DC current indicating an open circuit or short circuit fault for switching its phototransistor to a second state, means responsive to said second state for indicating the fault condition, an alarm condition monitor circuit including a diode coupled to one of said transmission lines and a photo-optical coupler in series with said diode for isolating said central station, said photo-optical coupler having a photo diode having its anode connected in series with the cathode of said diode such that said photo diode does not conduct when a DC signal of normal polarity is present on the lines so as to maintain its phototransistor in a first normal state indicating the absence of an alarm condition and such that said photo diode does conduct in response to a DC signal of reversed polarity on said lines so as to switch its phototransistor to a second alarm state indicating the presence of an alarm condition at said remote station, means including an SCR responsive to said second alarm state for switching said SCR to a conducting state, means responsive to said SCR being in said conducting state for indicating the existence of said alarm condition, and means for manually resetting said SCR to its non-conductive state after the alarm condition has been corrected at said remote station, and an audio monitoring circuit including a transformer for isolating the central station from the transmission lines, a DC blocking capacitor coupling a first transformer winding to said transmission lines, an audio amplifier having its inputs coupled to the second transformer winding, a threshold amplifier having its input coupled to one of the inputs of said audio amplifier for outputting a gating signal when the audio signal exceeds a predetermined threshold level, an audio gating means having its input coupled to the output of said audio amplifier and responsive to said gating signal from said threshold amplifier for passing the output from said audio amplifier and speaker means coupled to the output of said audio gating means for rendering the audio signals passed by said gating means audible to an operator at the central station so as to enable the operator to listen to the actual audio sounds originating in the protected remote location.

2. The security alarm system of claim 1 further characterized in that said plurality of alarm condition sensors includes a first normally-open switch responsive to the detection of a fire for being triggered to said second alarm condition to energize said relay and a second normally-open switch responsive to the detection of a hold-up for being triggered to said second alarm condition to energize said relay and signal injector means coupled between said alarm condition sensors and said high gain amplifier for injecting a first distinctive audio tone into said amplifier in response to said first normally-open switch having been triggered into said second alarm condition and a second different and distinctive audio tone into said amplifier in response to said second normally-open switch having been triggered into said second alarm condition.

3. The security alarm system of claim 2 further characterized in that said signal injector means comprises a first bistable flip-flop, a second bistable flip-flop, a first UJT oscillator coupled to a clocking input of said first flip-flop for generating clocking pulses to trigger said first flip-flop to output relatively long time duration pulses at a frequency "$n$", means coupling the output of said first flip-flop to an input of said second flip-flop for enabling said second flip-flop to output pulses only during the presence of one of said long duration pulses from the output of said first flip-flop, a second UJT oscillator coupled to the clocking input of said second flip-flop for generating clocking pulses to trigger the output of said second flip-flop to output relatively short time duration pulses at a frequency "$m$", where $m>n$, whenever said second flip-flop is enabled by the output of said first flip-flop, switching means coupled between said first and second normally open switches and said first and second UJT oscillators and responsive to a signal indicative of said second alarm condition for initiating the operation of said UJT oscillators, R-C means coupled to the output of said second flip-flop and to said first normally-open switch for stair-stepping the output of said second flip-flop in response to said first normally-open switch being in said second alarm condition, a UJT tone generator coupled to the output of said R-C circuit means for generating said first distinctive audio tone whenever said first normally open switch is in said alarm condition and said second different and distinct audio tone whenever said second normally open switch is in said alarm condition, and means coupling said first and second distinct audio tones to said high gain amplifier.

4. The security alarm system of claim 1 further characterized in that said manually operable multipositional switch further includes a "signal" position wherein a manually operable sending key is switched into series with said means coupling to said DC transmission signal to said output means for allowing manually coded DC transmission signals to be transmitted over said transmission lines to said central station, said coded signals appearing as intermittent open circuit conditions to said line supervision circuit and therefore being readable by the central station operator as the coded appearance and disappearance of said indicated line fault condition and yet further characterized in that said central station also includes a manually operable sending key coupled in series with one of said transmission lines, said sending key being operable to send coded DC transmission signals over said transmission lines to said remote station, said coded signals appearing as intermittent line current interruptions to said line current detector and therefore being visually readable at said remote station at said indicator means.

5. The security alarm system of claim 4 further characterized in that said manually operable multipositional switch further includes a "test" position wherein said indicator means is coupled into said closed loop means to provide a visual indication if the integrity of the perimeter security loop is broken.

6. A security alarm system comprising, in combination, a remote station to be protected, a central monitoring station and transmission lines coupled therebetween, said remote location including means for generating a DC transmission signal having a first normal polarity, output means for coupling said signal to said transmission lines, means for coupling said generated DC signal to said output means, a reversing relay having a normally de-energized relay coil, a first relay-operated switch coupled into said coupling means for normally supplying said first polarity of said generated DC signal to said output means but responsive to the energization of said relay coil for reversing said first normal polarity of said DC signal supplied to said output means, a plurality of alarm condition monitoring means coupled to said relay means and responsive to the detection of an alarm condition for energizing said relay coil, an audio monitoring system for detecting sounds in the protected area, means for superimposing the AC audio signals onto tbe DC transmission signal at said ouput means, a manually operable switch for turning said audio monitoring system on and off, and second relay-operated switch responsive to the energization of said relay coil for overriding the off condition of the manual switch to operate the audio monitoring system; and wherein said central station includes input means coupled to said transmission lines, a first line supervision circuit coupled to said input means for monitoring for the occurrence of an open circuit or short circuit condition, said first circuit including a photo-optical coupler for isolating the central station from the input means, fault indicator means coupled to said photo-optical coupler and responsive to the detection of an open circuit or short circuit condition for indicating a fault condition; a second alarm condition monitoring circuit coupled to said input means for detecting a reversal of the polarity of the DC signal indicative of the occurrence of an alarm condition at the remote station, said second circuit including a photo-optical coupler for isolating said central station from said input means, alarm indicator means coupled to said photo-optical coupler and responsive to the detection of an alarm condition for indicating same; and a third audio circuit coupled to said input means for monitoring for audible sounds at the remote location, said third circuit including a transformer for isolating said central station from the input means, an audio amplifier coupled to said transformer, a threshold amplifier coupled to one input of the audio amplifier for generating a gating signal when the level of the audio signal exceeds a predetermined threshold level, an audio gating means having an audio gate controlled by the output of said threshold amplifier for passing the amplifier output of said audio amplifier whenever said gating means is gated by said gating signal and speaker means coupled to the output of said audio gating means for rendering audible all those signals passed by said gating means.

7. The security alarm system of claim 6 further characterized in that said first circuit of said central station includes a full wave rectifier coupled to said input means for insuring a DC signal to said photo-optical coupler regardless of the polarity of the incoming signal, said photo-optical coupler including a photo diode in series with the output of said full wave rectifier, said photo diode being adapted to emit radiation so long as a DC signal of either polarity is present at said input means, said photo optical coupler further including a phototransistor responsive to the emission of radiation from said photo diode for normally maintaining a conductive state but responsive to the failure of said photo diode to emit radiation which is indicative of an open circuit or short circuit fault condition for switching to a second non-conductive state; said fault indicator means includes a transistor switch responsive to the normally conductive state of said phototransistor for maintaining a fault indicator in a "no fault" state but responsive to said nonconductive state of said photoresistor for triggering said fault indicator to a "fault" state; said second circuit of said central station includes a diode coupled between said input means and said photo-optical coupler for providing a signal to said photo-optical coupler only when the reversed polarity of DC signal is present at said input means, said photo-optical coupler includes a photo diode which is normally nonconductive while a normal polarity DC signal is present but which is responsive to the presence of a reversed polarity signal indicative of an alarm condition for conducting to emit radiation, said photo-optical coupler further including a phototransistor normally maintaining itself in a nonconductive state but responsive to the emission of radiation from said photo diode for switching to a conductive state; and said alarm indicator means includes a latching circuit responsive to the conductive state of said phototransistor for latching an alarm indicator to an "alarm" state, said latching circuit further including manually operable unlatching means for restoring said alarm indicator means to a normal condition after said alarm condition has been corrected at said remote station.

8. The security alarm system of claim 6 further characterized in that said remote station further includes a line current detector coupled into series with said means for coupling said generated DC signal to said output means for indicating a failure to transmit said DC signal indicative of a line fault condition, said line current detector including a photo-optical coupler having its photo diode connected in series with said coupling means such that said photo diode conducts current and emits radiation so long as said DC signal is transmitted but ceases to emit radiation when conduction stops due to a failure to transmit said DC signal which indicates said line fault condition, said photo-optical coupler having its phototransistor adapted to maintain a normally conductive state so long as it receives radiation from said photo diode but responsive to the failure of said photo diode to emit radiation for switching to a nonconductive state; and said line current detector further includes a transistor switch and a warning light coupled between a source of potential and said transistor switch, said transistor switch being responsive to the normally conductive state of said phototransistor to maintain said warning light off but being responsive to the nonconductive state of said phototransistor for switching said warning light on.

9. The security alarm system of claim 8 further characterized in that said manually operable switch includes a "signal" position and said means for coupling said generated DC signal to said output means includes means responsive to said manually operable switch being in said "signal" position for switchably connecting a manually operable coding key into said coupling means to enable the transmission of said DC signal to be intermittently broken to send a manually coded signal to said central station, said coded signal being readable at said central station by the fault indicating means of the first line supervision circuit; and yet further characterized in that the input means of said central station includes a manually operable coding key in series with one of said transmission lines to enable the receipt of said DC signal to be selectively intermittently interrupted to transmit a coded DC signal to said remote station, said coded signal being readable at said remote location by observing the intermittent on-off position of said warning light as said line current detector senses the corresponding intermittent interruptions in the transmission of the DC signal.

10. The security alarm system of claim 6 further characterized in that said plurality of alarm condition monitoring means including different and distinct circuit means for detecting different and distinct types of alarm conditions and separate output means for each of the different and distinct circuit means; and said remote station further includes an audio signal injector means coupled to the separate output means of said different and distinct circuit means and responsive to outputs therefrom for generating different and distinct audio tones for each different and distinct type of alarm condition for coupling said audio tones into said audio amplifier for superimposition on said DC signal and transmission to the third audio circuit for said central station to allow the operator thereof to audibly differentiate between the various different and distinct types of alarm conditions.

11. The security alarm system of claim 10 further characterized in that said injector means interrupts the generation of said audio tones during periodic intervals for certain of said different and distinct types of alarm conditions to allow the central station operator to listen for sounds detected by the audio monitoring system at the remote station during said periodic intervals.

12. A security alarm system with audio monitoring capability comprising, in combination, a remote location to be protected, a central monitoring station and transmission lines coupled between said remote location and said central station, said remote location including means for normally transmitting a DC signal of having a first polarity over said transmission lines, electrical circuit means for sensing various alarm conditions, means responsive to said circuit means having sensed an alarm condition for reversing the polarity of the transmitted DC signal, audio pickup means for strategically placed about said remote location for monitoring audio sounds therein, and means for superimposing the AC audio signals on the DC signal for transmission to said central station; said central station including a first circuit isolated from said transmission lines by a photo-optical coupled for detecting an open circuit or short circuit condition, a second circuit isolated from said transmission lines by a second photo-optical coupler for detecting the reversal of the polarity of the DC signal and indicating the presence of an alarm condition, and a third circuit isolated from the transmission lines by a transformer for receiving the superimposed audio signals and rendering all audio signals above a predetermined level audible to the operator at the central station, said electrical circuit means for sensing various alarm conditions including different and distinct circuits for sensing different and distinct alarm conditions, said remote location further including audio signal injector means coupled to the outputs of said different and distinct circuits for generating a unique different and distinct audio signal for each of said different and distinct alarm conditions sensed by said circuits and for coupling said unique audio signals to said superimposing means for transmission to said third circuit of said central station where said unique audio signals are rendered audible to identify the specific type of alarm condition sensed at said remote station.

* * * * *